United States Patent [19]

Akram

[11] Patent Number: 4,500,831

[45] Date of Patent: Feb. 19, 1985

[54] CURRENT SOURCE

[75] Inventor: M. Faheem Akram, Mesa, Ariz.

[73] Assignee: Motorola, Inc., Schaumburg, Ill.

[21] Appl. No.: 453,329

[22] Filed: Dec. 27, 1982

[51] Int. Cl.[3] ..... G05F 3/08

[52] U.S. Cl. ..... 323/315; 323/907

[58] Field of Search ..... 323/311, 312, 315, 316, 323/907

[56] References Cited

U.S. PATENT DOCUMENTS 3,893,017 7/1975 Williams ..... 323/315

FOREIGN PATENT DOCUMENTS 68946 6/1977 Japan ..... 323/315

*Primary Examiner*—William H. Beha, Jr.

*Attorney, Agent, or Firm*—William E. Kock

[57] ABSTRACT

A current source circuit is provided wherein the chip area consumption of a Miller multiplication capacitor is substantially reduced. A zero is created in addition to the pole created by the Miller multiplication capacitor. A first transistor is biased by a biasing means and has a base coupled to the emitter of a second transistor by a capacitor. The base of the second transistor is connected to the collector of the first transistor. A resistor is coupled between the emitter of the second transistor and ground.

1 Claim, 1 Drawing Figure

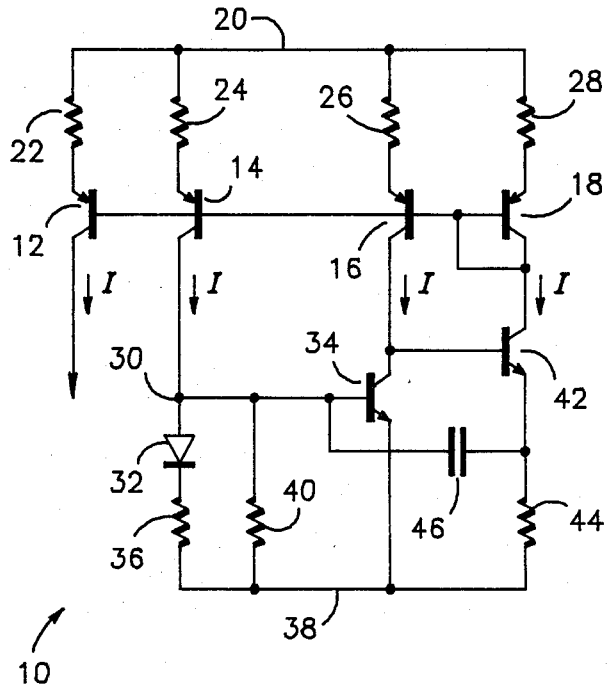
20
22
24
26
28
14
18
12
16
I
I
I
I
30
34
42
32
40
46
44
36
38
10

CURRENT SOURCE

BACKGROUND OF THE INVENTION

1. Field of the Invention

This invention relates, in general, to a current source and more particularly to a current source having a relatively small capacitor and resistor connected so as to compensate for oscillations while maintaining a high impedance.

2. Background Art

Some previously known current source circuits comprise a first NPN transistor having a base connected to a bias voltage and its collector and emitter coupled between supply voltages. A second NPN transistor has its base connected to the collector of the first transistor and its collector and emitter coupled between the supply voltages. PNP transistors are coupled between one of the supply voltages and the collectors of the first and second transistors to supply current thereto.

A feedback loop including the first and second NPN transistors and the PNP transistors possibly would cause oscillations that would appear in the current output. One common technique for stabilizing the circuit was to couple a relatively large capacitor, i.e. 100 picofarad, between the base of the first transistor and ground. Another compensation technique was to couple a capacitor between the base and collector of the first transistor, which gives the Miller multiplied capacitance at the base of the transistor.

However, since the emitter of the second transistor was grounded, the impedance at the collector of the first transistor was not very high, and the pole created was not sufficiently low in frequency because the gain was too low.

Therefore, what is needed is a current source circuit wherein the area consumption of an on-chip capacitor is reduced while giving the Miller multiplication effect by way of a higher impedance at the collector of the first transistor.

SUMMARY OF THE INVENTION

Accordingly, it is an object of the present invention to provide an improved current source.

Another object of the present invention is to provide a current source that includes an oscillation compensation capacitor having a substantially reduced area consumption.

A further object of the present invention is to provide a current source having a zero produced in addition to the pole created by the Miller capacitor.

In carrying out the above and other objects of the invention in one form, there is provided an improved current source circuit having first and second NPN transistors. A biasing means is connected to the base of the first transistor for determining the circuit's output current. The base of the second transistor is coupled to the collector of the first transistor. A frequency compensation capacitor is coupled between the base of the first transistor and the emitter of the second transistor, with the emitter of the second transistor further being coupled to ground by a resistor. This arrangement retains the Miller multiplication effect while supplying a zero in addition to the pole created thereby. The resistor creates a high impedance at the collector of the first transistor, giving a higher stage gain and, therefore, an increased Miller capacitance.

The above and other objects, features, and advantages of the present invention will be better understood from the following detailed description taken in conjunction with the accompanying drawing.

BRIEF DESCRIPTION OF THE DRAWING

The single FIGURE is a schematic of the current source circuit of the present invention.

DETAILED DESCRIPTION OF THE INVENTION

Referring to the single FIGURE, a current source circuit 10 is shown that is suitable to be fabricated in integrated circuit form as well as with discrete components. Current source PNP transistors 12, 14, 16, 18, have their emitters coupled to voltage terminal 20 by resistors 22, 24, 26, 28, respectively, and their bases interconnected. The collector of transistor 12 supplies current I as the output for circuit 10.

The collector of transistor 14 is connected to node 30 which is connected to the anode of diode 32 and the base of transistor 34. Resistor 36 is coupled between voltage terminal 38 and the cathode of diode 32. Resistor 40 is coupled between node 30 and voltage terminal 38, which may, for example, be grounded. Transistor 14 and resistor 24 provide current I to resistor 36, 40 and diode 32 which provides bias for transistor 34.

Transistor 34 has a collector connected to the collector of transistor 16 and an emitter connected to voltage terminal 38. Transistor 42 has its collector connected to the collector and base of transistor 18, and its base connected to the collector of transistor 34. The emitter of transistor 42 is coupled to voltage terminal 38 by resistor 44. Capacitor 46 is coupled between the base of transistor 34 and the emitter of transistor 42.

In the previously known current source circuits, capacitor 46 was coupled between the base and collector of transistor 34 in order to gain benefit from the Miller multiplication effect, and the emitter of transistor 42 was connected directly to ground. By having the emitter of transistor 42 grounded, the impedance at the collector of transistor 34 was not very high. Hence, the Miller multiplied capacitance was small, thereby resulting in a pole that was not sufficiently low in frequency.

By coupling capacitor 46 between the base of transistor 34 and the emitter of transistor 42, the phase relationship at the collector of transistor 34 and the emitter of transistor 42 is substantially the same. The addition of resistor 44 gives a much higher impedance at the collector of transistor 34, increasing its voltage gain. The voltage gain across the base-to-emitter junction of transistor 42 is one, therefore the Miller multiplication effect is retained. Additionally, a zero appears along with the low frequency pole created by the Miller multiplication. The location of the zero is roughly determined by the time constant of resistor 44 and capacitor 46. This zero may be suitably chosen in order to cancel the effect of one of the two lower frequency poles, thereby creating a system with essentially a single pole response.

By now it should be appreciated that there has been provided an improved current source circuit having a frequency compensation capacitor requiring a substantially reduced area consumption. A high impedance is maintained while a zero is created in addition to the pole obtained from the capacitor.

I claim:

1. A current source circuit having a first supply voltage terminal and a second supply voltage terminal, comprising:

biasing means for establishing a bias voltage comprising a first transistor having a first current conducting electrode coupled to said first supply voltage terminal, a first resistor coupled to said second supply voltage terminal, and a diode coupled between said first resistor and a second current conducting electrode of said first transistor;

a second transistor having a first current conducting electrode coupled to said first supply voltage terminal;

a third transistor having a control electrode coupled to said second current conducting electrode of said first transistor, a first current conducting electrode coupled to a second current conducting electrode of said second transistor, and a second current conducting electrode coupled to said second supply voltage terminal;

a fourth transistor having a control electrode coupled to said first current conducting electrode of said third transistor, and a first current conducting electrode coupled to said first supply voltage terminal;

a capacitor coupled between said control electrode of said third transistor and a second current conducting electrode of said fourth transistor;

resistive means coupled between said second current conducting electrode of said fourth transistor and said second supply voltage terminal; and a fifth transistor having a first current conducting electrode coupled to said first supply voltage terminal, a control electrode coupled to a control electrode of both said first and said second transistor, and a second current conducting electrode supplying an output current.

* * * * *